US009428317B2

(12) United States Patent
Kranz

(10) Patent No.: US 9,428,317 B2
(45) Date of Patent: Aug. 30, 2016

(54) PACKAGE FOR A PRODUCT WITH AT LEAST ONE HYGROSCOPIC POURABLE SOLID

(75) Inventor: Ralf Kranz, Erbach (DE)

(73) Assignee: Merck Patent GmbH, Darmstadt (DE)

( * ) Notice: Subject to any disclaimer, the term of this patent is extended or adjusted under 35 U.S.C. 154(b) by 153 days.

(21) Appl. No.: 13/586,098

(22) Filed: Aug. 15, 2012

(65) Prior Publication Data

US 2014/0021074 A1 Jan. 23, 2014

(30) Foreign Application Priority Data

Jul. 17, 2012 (EP) ..... 12005230

(51) Int. Cl.

| | |
|---|---|
| ***B65D 81/26*** | (2006.01) |
| ***F17C 11/00*** | (2006.01) |
| ***B65D 77/06*** | (2006.01) |

(52) U.S. Cl.

CPC ..... *B65D 81/268* (2013.01); *B65D 77/06* (2013.01)

(58) Field of Classification Search

CPC B65D 81/264; B65D 81/266; B65D 81/268; B65D 81/26; B65D 77/06; B01L 2200/185; F17C 11/00

USPC ..... 206/204, 466, 524.1, 524.4, 216, 811

See application file for complete search history.

(56) References Cited

U.S. PATENT DOCUMENTS

| | | | | |
|---|---|---|---|---|
| 2,524,162 | A * | 10/1950 | Chavannes | A23L 3/3418 206/204 |
| 4,813,791 | A * | 3/1989 | Cullen | B65D 81/268 206/204 |
| 6,308,826 | B1 * | 10/2001 | Merrell | 206/204 |
| 6,533,405 | B1 * | 3/2003 | Sleger | B41J 2/17536 347/92 |
| 8,528,469 | B2 * | 9/2013 | Doglioni Majer | B65D 75/38 99/467 |
| 2007/0084866 | A1 * | 4/2007 | Saeugling | 220/495.06 |
| 2013/0193007 | A1 * | 8/2013 | Hahn | 206/204 |

* cited by examiner

*Primary Examiner* — Jacob K Ackun
*Assistant Examiner* — Rafael Ortiz
(74) *Attorney, Agent, or Firm* — Millen White Zelano & Branigan, P.C.

(57) ABSTRACT

In a package (1) for a product (3) with at least one hygroscopic pourable solid, to a shipping container (4) [sic] there is a desiccant wrapper (10) of moisture-tight material that surrounds a product bag (2) filled with the product (3) and in which the desiccant (14) is located on an inner side (11) of the desiccant wrapper (10) facing the product bag (2). The desiccant (14) is located in at least one, preferably in several, desiccant bag(s) (13). The at least one desiccant bag (13) is fixed and covered by a moisture-permeable perforated cover (16) on the inner side (11) of the desiccant wrapper (10). The desiccant wrapper (10) is matched either to the shape of the product bag (2) or to the shape of the shipping container (4). The product bag (2) for holding the product (3) is a non-woven textile of thermally bonded fibers of high density polyethylene. The desiccant wrapper (10) is a thin wrapper of polyethylene or has such a wrapper or coating.

8 Claims, 2 Drawing Sheets

PACKAGE FOR A PRODUCT WITH AT LEAST ONE HYGROSCOPIC POURABLE SOLID

Figure 1:
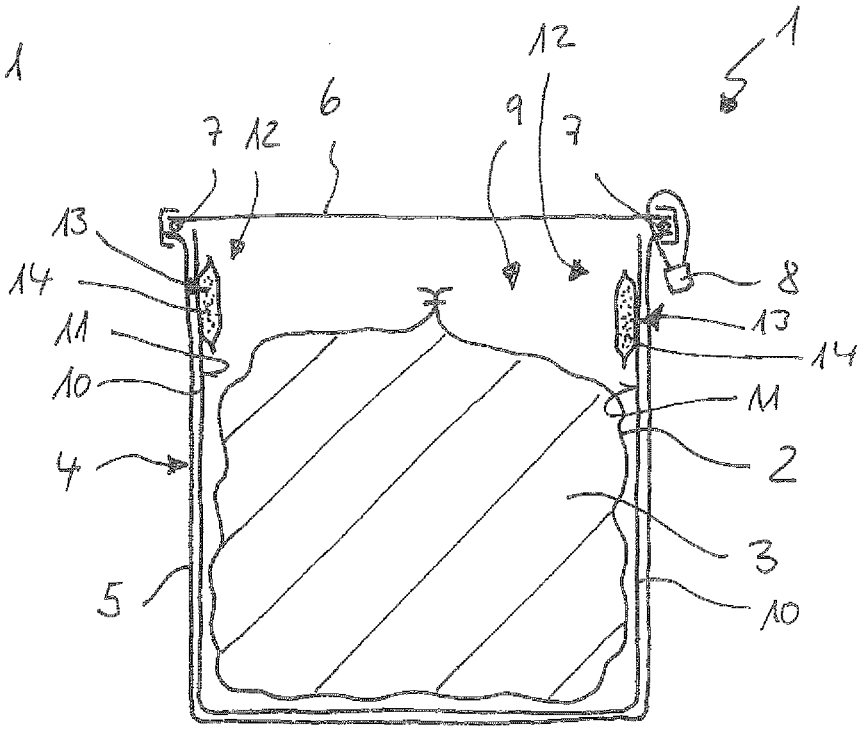

The invention relates to a package for a product with at least one hygroscopic pourable solid, the package having a sealable product bag of moisture-permeable material for accommodating the product, a shipping container that surrounds the product bag, and a desiccant that is located outside of the product bag and within the shipping container.

In the chemical or pharmaceutical industry, hygroscopic pourable solids, such as, for example, powdered substances, must often be transported and stored before they are supplied to a use as directed. Numerous different packages for this purpose are known from practice. In many different packages, the product or the chemical substance is decanted in a sealable product bag for protection against impurities and then placed in a shipping container. The shipping container can be, for example, a drum or a box.

For a product that consists either of a hygroscopic substance or has at least one hygroscopic component and is powdered or granulated or pourable, there is frequently the risk that moisture during the decanting process or subsequently during transport or storage, the product has residual moisture and agglomerates [sic]. If a larger amount of moisture ends up on and in the product over a longer time interval, the pourability of the product can be reduced or can completely disappear and can set up the product to form one or more large clumps.

In order to reduce the risk of agglomeration or setting-up of the product during transport and storage, making the surrounding shipping container moisture-tight, and, after filling it with the product, sealing it moisture-tight are known. It still cannot be precluded, however, that during filling and especially in a successive removal of the product and a resulting repeated opening and closing of the shipping container, moisture will travel into the interior of the shipping container and lead to agglomeration or setting-up of the hygroscopic product.

In order to avoid these adverse effects of moisture found in the shipping container, placing a desiccant in the shipping container that absorbs and stores the moisture found in the shipping container is known from practice. Conventionally, the desiccant is located in a bag or in several bags. These desiccant bags that are filled with a desiccant are placed either in front of or after the product-filled product bag in the shipping container. However, especially during, for example, transport-induced moving and shaking of the shipping container, it cannot be precluded that the desiccant bags will leave their initial position and collect somewhere within the shipping container, as a result of which further moisture absorption is concentrated on the region around the desiccant bags, and the moisture absorption by the desiccant bags is hindered in regions remote therefrom.

It is known from practice that the desiccant bags, for example, are fixed with tapes or loops in the region of a sealable opening of the product bag that has been filled with the product. The effort necessary for this purpose is considerable. The desiccant bags, however, can be located and fixed in the region of the opening of the product-filled product bag, but not without greater effort just anywhere in the product bag, or within the shipping container.

Placing a moisture-permeable absorption device, in which a desiccant bag can be located, in the shipping container is likewise known from practice. Shipping containers that have these absorption devices, for example in the form of small pockets or skeleton containers for holding a desiccant bag, are complex and costly to produce. The absorption devices project into the interior of the shipping containers and under certain circumstances can damage the product-filled product bag. The shipping container that has been provided with these absorption devices must either have had to have been provided for this purpose and produced accordingly, or to have been equipped subsequently with the absorption devices. Often, in addition to the costs that arise in addition for this purpose, it is perceived as a serious disadvantage that only corresponding shipping containers are suitable for the transport of hygroscopic products, and the latter must be kept ready in a sufficient amount and separated from shipping containers without these absorption devices.

Therefore, one object of this invention is to configure a package for a product with at least one hygroscopic pourable solid component such that with the simplest means possible, moisture is economically absorbed in the shipping container, and agglomeration or setting-up of the hygroscopic product can be reduced or completely avoided.

This object is achieved according to the invention in that in the shipping container, there is a desiccant wrapper of a moisture-tight material that surrounds the product bag with the product, and in that the desiccant is located on an inner side of the desiccant wrapper, which inner side faces the product bag with the product. By using a desiccant wrapper, regardless of the product bag used for holding the product and regardless of the shipping container, the arrangement of the desiccant within the shipping container or in the vicinity of the product bag with the product can be stipulated. Costly and complex modifications of the shipping container are not necessary. It is likewise of little necessity to attach the desiccant to the product bag or in the sealing region of the product bag after filling the product bag with the products and subsequent sealing of the product bag.

The use of a desiccant wrapper that can be subsequently inserted into an already existing shipping container makes it possible to retrofit the already existing shipping container and to use it for the transport of hygroscopic products. Since the desiccant wrapper can be used with various shipping containers, existing marketing systems with the corresponding shipping containers can be retained unchanged. The added cost for procurement and use of the desiccant wrapper is extremely low.

The desiccant wrapper can be made reusable and can remain in the shipping container after the product bag with the product is removed so that the desiccant wrapper is further available for re-use of the shipping container. It is likewise possible to design and produce the desiccant wrapper for one-time use and to make it a disposable product.

By using a product bag that consists of a moisture-permeable material, the action of the desiccant is intensified. If there should be a residue of moisture in the product bag or in the product located in it or if it should be collected after opening and re-closing the product bag, this moisture is transported by the moisture-permeable product bag into the intermediate space between the product bag and the surrounding desiccant wrapper and can be absorbed and bound there by the desiccant.

According to one configuration of the inventive idea, it is provided that the desiccant is located in at least one desiccant bag that is fixed on one inner side of the desiccant wrapper. These desiccant bags are commercially and cheaply available for various desiccants in numerous variants and shapes. The desiccant bag can be easily and reliably fixed on the desiccant wrapper, for example, by bonding, cementing or sewing. Suitably, several desiccant bags are fixed spaced apart from one another on the desiccant wrapper in order to promote the moisture absorption by the desiccant located in the desiccant bags and to prevent the desiccant from being concentrated in a small region within the shipping container and in other areas to prevent the moisture from not being absorbed or being absorbed only to a minor degree.

Especially simple and effective fixing of the transport agent bag [sic] on the desiccant wrapper can be achieved in that the at least one desiccant bag is fixed and covered by a moisture-permeable cover on the inner side of the desiccant wrapper. The moisture-permeable cover can be perforated and can be produced from the same moisture-tight material as the desiccant wrapper. If the desiccant wrapper consists of, for example, a film, the desiccant bags can be located in pockets that are produced by repeated turning-down and subsequent fixing, or cementing or bonding of the pockets of the desiccant wrapper that have been formed in this way.

According to one especially advantageous configuration of the inventive idea, it is provided that the desiccant wrapper is matched to the shape of the shipping container. The transport wrapper [sic] can be inserted into the interior of the shipping container and can form an inner lining of the shipping container. By matching the desiccant wrapper to the shape of the shipping container, the arrangement of the desiccant wrapper in the shipping container or relative to the shipping container can be stipulated, and in this way, the position of the desiccant bag fixed on the desiccant wrapper in the interior or on the walls of the shipping container can be predetermined. The desiccant wrapper that adjoins the shipping container does not inhibit the filling of the shipping container with the product bag that for its part is filled with the product.

It is likewise conceivable and advantageous for individual applications if the desiccant wrapper is matched to the shape of the product bag. The product-filled product bag can then be placed in the desiccant wrapper, whereby the arrangement of the desiccant or of the individual desiccant bags relative to the filled product bag is stipulated. In this way, a distribution of desiccant that is as uniform as possible on the product bag and thus in the immediate vicinity of the product can also be ensured for the case in which the filled product bag fills only a partial area of the shipping container and often changes its position and shape within the shipping container during transport.

For many applications or products, it is already sufficient if some few desiccant bags are located in the shipping container. In these cases, it can be advantageous that the desiccant is located solely in a region of the desiccant wrapper that faces an opening of the shipping container. Conventionally, when the shipping container is filled in the region of the opening of the shipping container, there remains an unused volume in which after sealing the shipping container, there is air that generally has a moisture content. The arrangement of the desiccant in this region can enable effective dehumidification of the air located in the shipping container. Moreover, each time the shipping container is opened, for example, for a successive and gradual removal of the product, in each case new and humid air flows into the shipping container, which collects in the region near the opening and can be effectively dehumidified there.

In particular, for expectedly high atmospheric humidity or for a product that is especially endangered by moisture, it can be feasible to arrange the desiccant distributed over the entire inside of the desiccant wrapper. Thus, for example, a larger number of desiccant bags can be fixed on the desiccant wrapper distributed at regular or, however, irregular intervals over the inside of the desiccant wrapper. Regardless of the shape of the product bag that is filled with the product and regardless of the amount of product remaining after partial removal in the shipping containers, it can thus be ensured that in the vicinity of the product bag, there are several desiccant bags spaced apart from one another.

In order to support a dehumidification of the product located in the product bag, it is provided that the product bag is a nonwoven textile of thermally bonded fibers of high density polyethylene (HDPE). This nonwoven material is already extensively used in practice. The advantageous properties of this nonwoven material in addition to high moisture and air permeability also encompass a high tear resistance and non-problematic use jointly with numerous hygroscopic products of the chemical industry or the pharmaceutical industry.

One especially economical and at the same time effective and moisture-tight desiccant wrapper consists of a thin wrapper or film of polyethylene or has such a thin wrapper of polyethylene as a coating or individual layer of the desiccant wrapper. With respect to simple and economical production, the individual desiccant bags are covered and fixed by a cover on the inner side of the desiccant wrapper that can likewise consist of a thin polyethylene film that is permeable to moisture due to a perforation.

Figure 2:
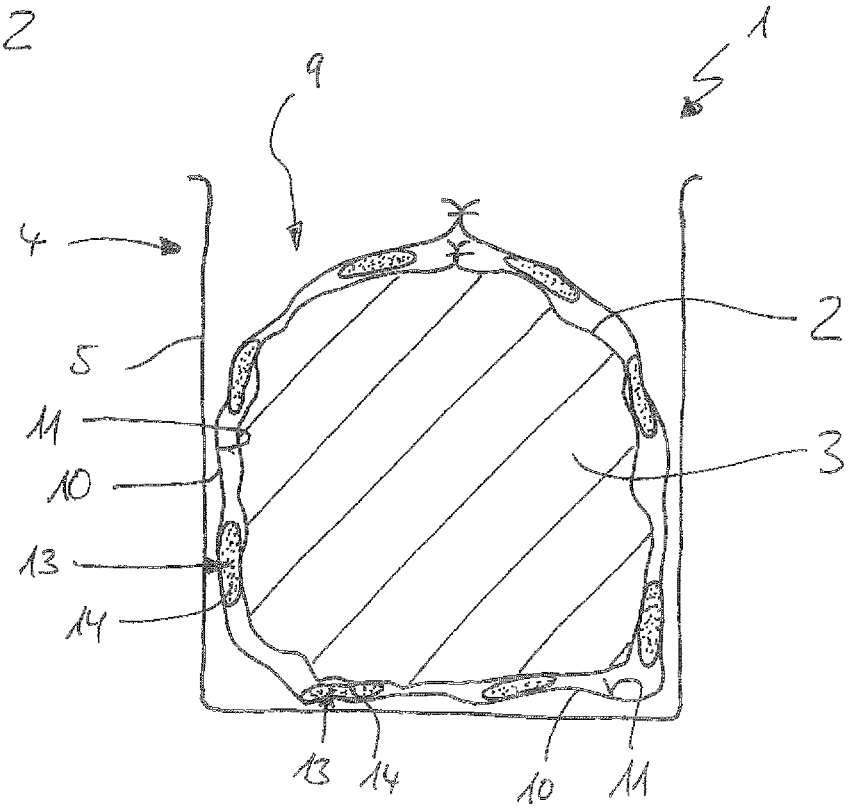
Figure 3:
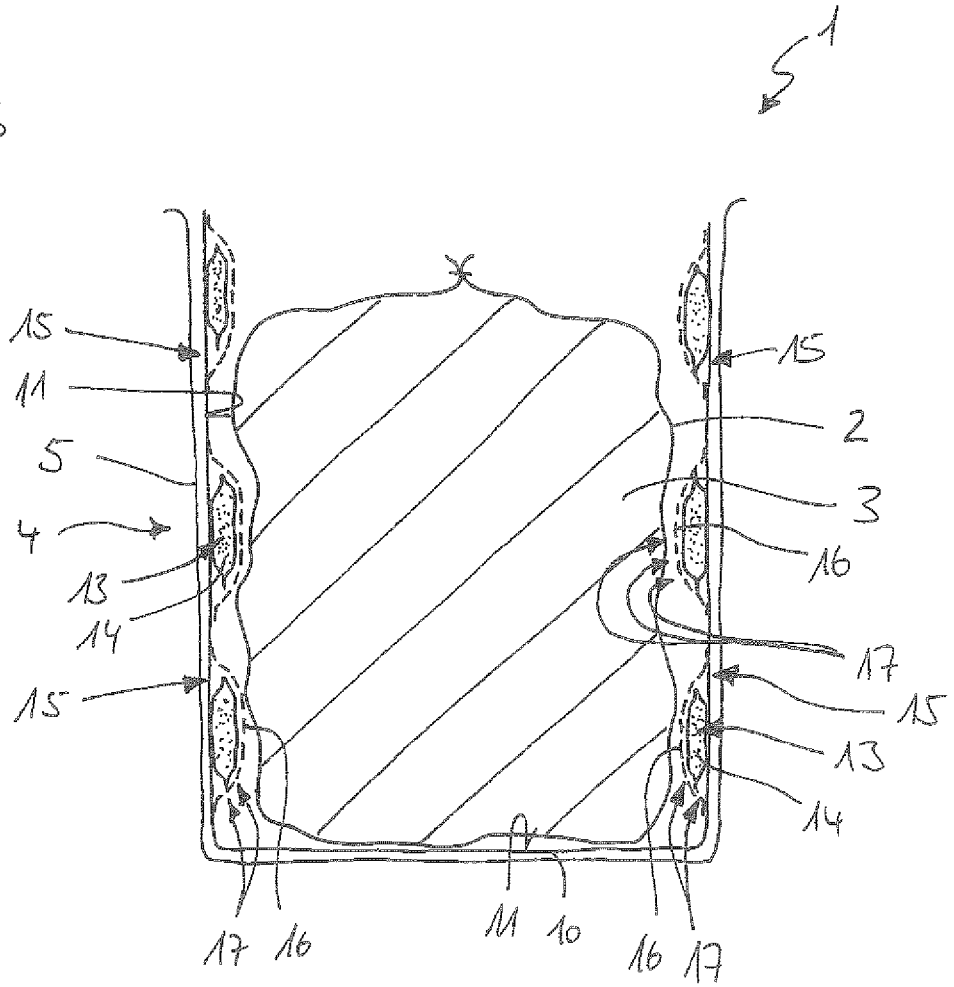

The invention is explained in more detail using several embodiments that are shown in the drawings. Here:

FIG. 1 shows a sectional view of a package with a shipping container, with a desiccant wrapper that is located in the shipping container, and with a product bag that is filled with a product, FIG. 2 shows a sectional view of another package in which the desiccant wrapper closely surrounds the product-filled product bag, and FIG. 3 shows a sectional view of, in turn, another embodiment of a package, in which the desiccant wrapper that adjoins the shipping container has several desiccant bags that are fixed by a perforated cover laterally on the desiccant wrapper.

A package 1 that is shown by way of example in FIG. 1 has a sealable product bag 2 that is filled with a pourable hygroscopic product 3. The product bag 2 consists of a moisture-permeable nonwoven material of high density polyethylene (HDPE) fibers. The hygroscopic product 3 can be, for example, a chemical substance that is required for the production of end products in the chemical or pharmaceutical industry.

The sealable product bag 2 is located in a shipping container 4 that surrounds the product bag 2. The shipping container 4 has a drum-like base body 5 that can be closed with a cover. The shipping container 4 consists of a moisture-tight material, for example of polyethylene. The cover 6 can be arranged and fixed moisture-tight on the base body 5 by additional sealing elements 7 in order to seal the shipping container 4 moisture-tight. If it seems necessary, the sealed shipping container 4 can be additionally provided with an originality security device, for example in the form of a seal.

In the interior 9 of the shipping container 4, there is a desiccant wrapper 10 that is matched to the shape of the shipping container 4. The desiccant wrapper 10 consists of a thin polyethylene film and is likewise made moisture-tight. On one inner side 11 of the desiccant wrapper 10 facing the product bag 2 with the product 3 that is located in it, in a region 12 of the desiccant wrapper 10 facing the cover 6 of the shipping container 4, several desiccant bags 13 are cemented onto the inner side 11 of the desiccant wrapper 10.

The desiccant bags 13 contain a suitable desiccant 14, for example silica gel or zeolites, nonaqueous sodium sulfate or magnesium sulfate.

The moisture that is located in the free interior 9 of the shipping container 4 is absorbed and bound by the desiccant 14 in the desiccant bags 13 that are located in this region 12 of the desiccant wrapper 10. If residues of moisture are located in the product 3, they are transported by the product bag 2 into the then dry interior 9 of the shipping container 4 and are absorbed and bound there likewise by the desiccant 14.

In the embodiment shown in FIG. 2, the shape of the desiccant wrapper 10 is matched to the shape of the product bag 2, so that the desiccant wrapper 10 tightly surrounds the filled product bag 2. On the inner side 11 of the desiccant wrapper 10, at regular intervals several desiccant bags 13 are attached that each contain a portion of the desiccant 14. The product bag 2 and the product 3 that is located in it are accordingly uniformly desiccated from all sides. In this variant embodiment of the package 1, the shape of the surrounding shipping container 4 is not important.

In the embodiment shown in FIG. 3, the shape of the desiccant wrapper 10 is matched to the shape of the shipping container 4 so that the desiccant wrapper 10 forms a lining of the side walls and the bottom of the shipping container. The desiccant wrapper 10 can be inserted before placing the product bag 2 in the shipping container 4 and does not hinder the subsequent placement of the product bag 2 even in a state already filled with the product. The desiccant wrapper 10 has desiccant bags 13 that are distributed over its side surfaces 15 with one portion of the desiccant 14 in each case. Each individual desiccant bag 13 is covered with a cover 16 of a section of a polyethylene film matched thereto and is fixed on the side surface 15 of the desiccant wrapper 10. The individual covers 16 are in each case provided with a perforation 17 so that the covers are moisture-permeable in spite of the material polyethylene that is impermeable to moisture.

The invention claimed is:

1. Package (1) for a product (3) with at least one hygroscopic pourable solid, the package (1) having a sealable product bag (2) of moisture-permeable material for accommodating the product (3), a shipping container (4) that surrounds the product bag (2), and a desiccant (14) for absorbing moisture that is located outside of the product bag (2) and within the shipping container (4), characterized in that in the shipping container (4), there is a detachable desiccant wrapper (10) of a moisture-tight material that surrounds the product bag (2) with the product (3), and in that the desiccant (14) is located on an inner side (11) of the desiccant wrapper (10) facing the product bag (2) wherein the desiccant (14) is located in desiccant bags (13) fixed on the inner side (11) of the detachable desiccant wrapper (10) and distributed over the inner side (11) of the detachable desiccant wrapper (10) and wherein the desiccant (13) bags are fixed on the inner side (11) of the detachable desiccant wrapper by bonding, cementing or sewing and covered by a moisture-permeable cover (17) on the inner side (11) of the detachable desiccant wrapper (10), and wherein the sealable product bag (2) of moisture-permeable material for accommodating the product (3) is a nonwoven textile of thermally bonded fibers of high density polyethylene (HDPE).

2. Package (1) according to claim 1, wherein the moisture-permeable cover (17) is a film.

3. Package (1) according to claim 1, wherein the detachable desiccant wrapper (10) is matched to the shape of the shipping container (4).

4. Package (1) according to claim 1, wherein the desiccant (14) is located in desiccant bags (13) distributed only in one region (12) of the detachable desiccant wrapper (10) facing an opening of the shipping container (4).

5. Package (1) according to claim 1, wherein the detachable desiccant wrapper (10) is or has a thin polyethylene wrapper.

6. Package (1) according to claim 1, wherein the detachable desiccant wrapper (10) is or has a thin polyethylene bag.

7. Package (1) for a product (3) with at least one hygroscopic pourable solid, the package (1) having a sealable product bag (2) of moisture-permeable material for accommodating the product (3), a shipping container (4) that surrounds the product bag (2), and a desiccant (14) for absorbing water that is located outside of the product bag (2) and within the shipping container (4), characterized in that in the shipping container (4), there is a detachable desiccant wrapper (10) of a moisture-tight material that surrounds the product bag (2) with the product (3), and in that the desiccant (14) is located on an inner side (11) of the desiccant wrapper (10) facing the product bag (2) wherein the desiccant (14) is located in desiccant bags (13) that are fixed on the inner side (11) of the detachable desiccant wrapper (10) by bonding, cementing or sewing and covered by a moisture-permeable cover (17) on the inner side (11) of the detachable desiccant wrapper (10) and distributed over the inner side (11) of the detachable desiccant wrapper (10), wherein the detachable desiccant wrapper (10) is matched to the shape of the product bag (2) and wherein the sealable product bag (2) of moisture-permeable material for accommodating the product (3) is a nonwoven textile of thermally bonded fibers of high density polyethylene (HDPE).

8. Package (1) according to claim 7, wherein the detachable desiccant wrapper (10) is or has a thin polyethylene bag.

* * * * *